US008046873B2

(12) United States Patent
Chang

(10) Patent No.: US 8,046,873 B2
(45) Date of Patent: Nov. 1, 2011

(54) SPIDER HINGE FOR A FRAMELESS GLASS DOOR

(76) Inventor: James Chang, Taichung (TW)

( * ) Notice: Subject to any disclaimer, the term of this patent is extended or adjusted under 35 U.S.C. 154(b) by 538 days.

(21) Appl. No.: 12/234,710

(22) Filed: Sep. 22, 2008

(65) Prior Publication Data

US 2010/0071160 A1 Mar. 25, 2010

(51) Int. Cl.
*E05D 5/02* (2006.01)

(52) U.S. Cl. ..... 16/252; 16/281; 16/387

(58) Field of Classification Search ..... 16/227, 16/236, 238, 247, 252, 281–283, 286–287, 16/387; 4/557, 608; 49/381, 399
See application file for complete search history.

(56) References Cited

U.S. PATENT DOCUMENTS

| | | | | |
|---|---|---|---|---|
| 5,079,798 | A * | 1/1992 | Burke et al. | 16/252 |
| 5,867,869 | A * | 2/1999 | Garrett et al. | 16/252 |
| 6,481,055 | B2 * | 11/2002 | Cheng | 16/252 |
| 6,519,811 | B1 * | 2/2003 | Cheng | 16/252 |
| 6,526,627 | B2 * | 3/2003 | Chiang | 16/284 |
| 6,560,821 | B2 * | 5/2003 | Miller et al. | 16/252 |
| 6,704,966 | B1 * | 3/2004 | Kao | 16/252 |
| 6,766,561 | B1 * | 7/2004 | Cheng | 16/235 |
| 7,010,832 | B2 * | 3/2006 | Chen | 16/252 |
| 7,114,292 | B2 * | 10/2006 | Chiang | 49/388 |
| 7,188,390 | B2 * | 3/2007 | Cheng | 16/252 |
| 7,917,994 | B2 * | 4/2011 | Bai | 16/252 |
| 2005/0144757 | A1 * | 7/2005 | Chiang | 16/252 |
| 2008/0083086 | A1 * | 4/2008 | Lin | 16/252 |
| 2008/0168621 | A1 * | 7/2008 | Lin | 16/252 |
| 2010/0275409 | A1 * | 11/2010 | Walhorn et al. | 16/235 |

* cited by examiner

*Primary Examiner* — Robert Sandy
*Assistant Examiner* — Roberta Delisle

(57) ABSTRACT

A spider hinge for a frameless glass door includes a base plate, a pivot block connected to the base plate, a swing base pivotally connected to the pivot block, and a positioning mechanism disposed between the pivot block and the swing base. The swing base has two legs slantwise extending therefrom. Each leg has a round frustum extending therefrom. The round frustum has a threaded hole define in one side thereof for assembling with a fastener. The glass door is secured by fastening the fastener and the round frustum. The positioning mechanism includes two springs and a positioning block connected to the two springs and biased by the springs. The pivot block has multiple cavities for selectively receiving the positioning block to achieve the purpose of positioning the swing base.

12 Claims, 13 Drawing Sheets

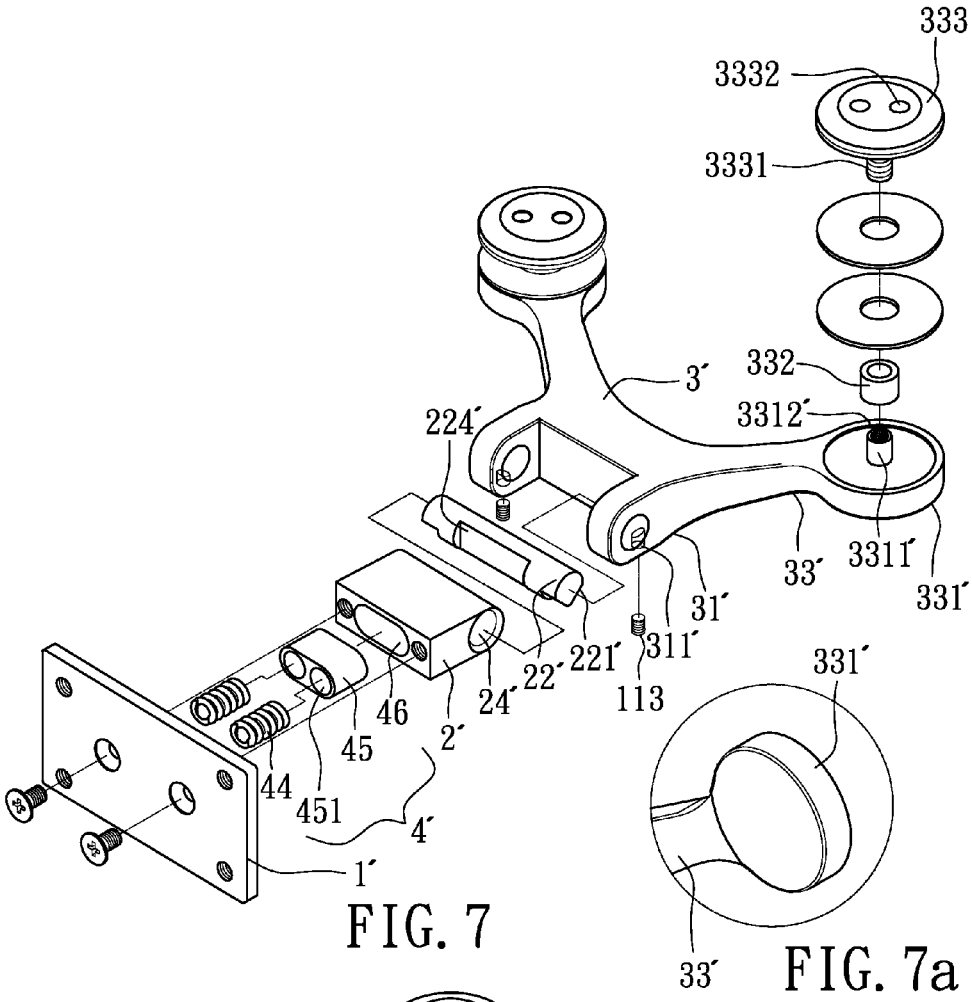
FIG. 7
FIG. 7a
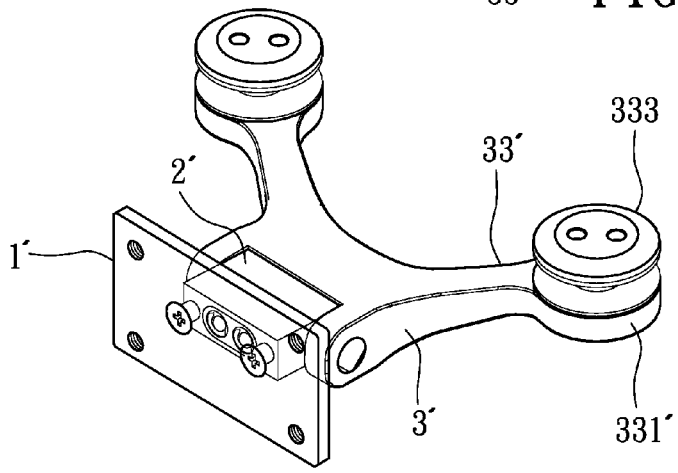
FIG. 8

SPIDER HINGE FOR A FRAMELESS GLASS DOOR

BACKGROUND OF THE INVENTION

1. Field of the Invention

The present invention relates to a hinge, and more particularly to a spider hinge for a frameless glass door.

2. Description of Related Art

A conventional spider fitting for a glass in accordance with the prior art shown in FIGS. 20 and 21 comprises a body 91 and four legs 92 radially extending from the body 91. Each leg 92 has a free end formed with a round ring 93. Each round ring 93 has a through hole 94 centrally defined therein and aligning with a corresponding one of four openings in the glass. A fastener extends through the aligned through hole 94 and the opening for assembling the spider fitting and the glass.

Although the conventional spider fitting provides the effort of securing the glass, the legs can not pivot around the body. The conventional spider fitting is provided for connecting the continuous and immovable glasses not for glass door.

The present invention has arisen to mitigate and/or obviate the disadvantages of the conventional spider fitting for glass.

SUMMARY OF THE INVENTION

The main objective of the present invention is to provide an improved spider hinge for a frameless glass door, in that a pivotable and positionable spider hinge for a frameless glass door is obtained.

To achieve the objective, the spider hinge for a frameless glass door comprises a base plate, a pivot block connected to the base plate, a swing base pivotally connected to the pivot block, and a positioning mechanism disposed between the pivot block and the swing base. The swing base has a pair of ears extending outwardly therefrom for pivotally connecting to the pivot block and two legs slantwise extending therefrom and opposite to the ears for fastening with the glass door. Each leg has a round frustum extending therefrom. The round frustum has a threaded hole define on one side thereof for assembling with a fastener. The glass door is secured by fastening the fastener and the round frustum. The positioning mechanism includes two springs and a positioning block connected to the two springs and biased by the springs. The pivot block has multiple cavities defined therein for selectively and partially receiving the positioning block to achieve the purpose of positioning the swing base.

Further benefits and advantages of the present invention will become apparent after a careful reading of the detailed description with appropriate reference to the accompanying drawings.

BRIEF DESCRIPTION OF THE DRAWINGS

FIG. 7 is an exploded perspective view of a second embodiment of the spider hinge for a frameless glass door in accordance with the present invention;

FIG. 7*a* is a schematic perspective view of a round frustum of the second embodiment of the spider hinge in accordance with the present invention, showing the opposite side;

FIG. 8 is an assembled perspective view of the second embodiment of the spider hinge in accordance with the present invention;

DETAILED DESCRIPTION OF THE INVENTION

Figures 1, 1A:
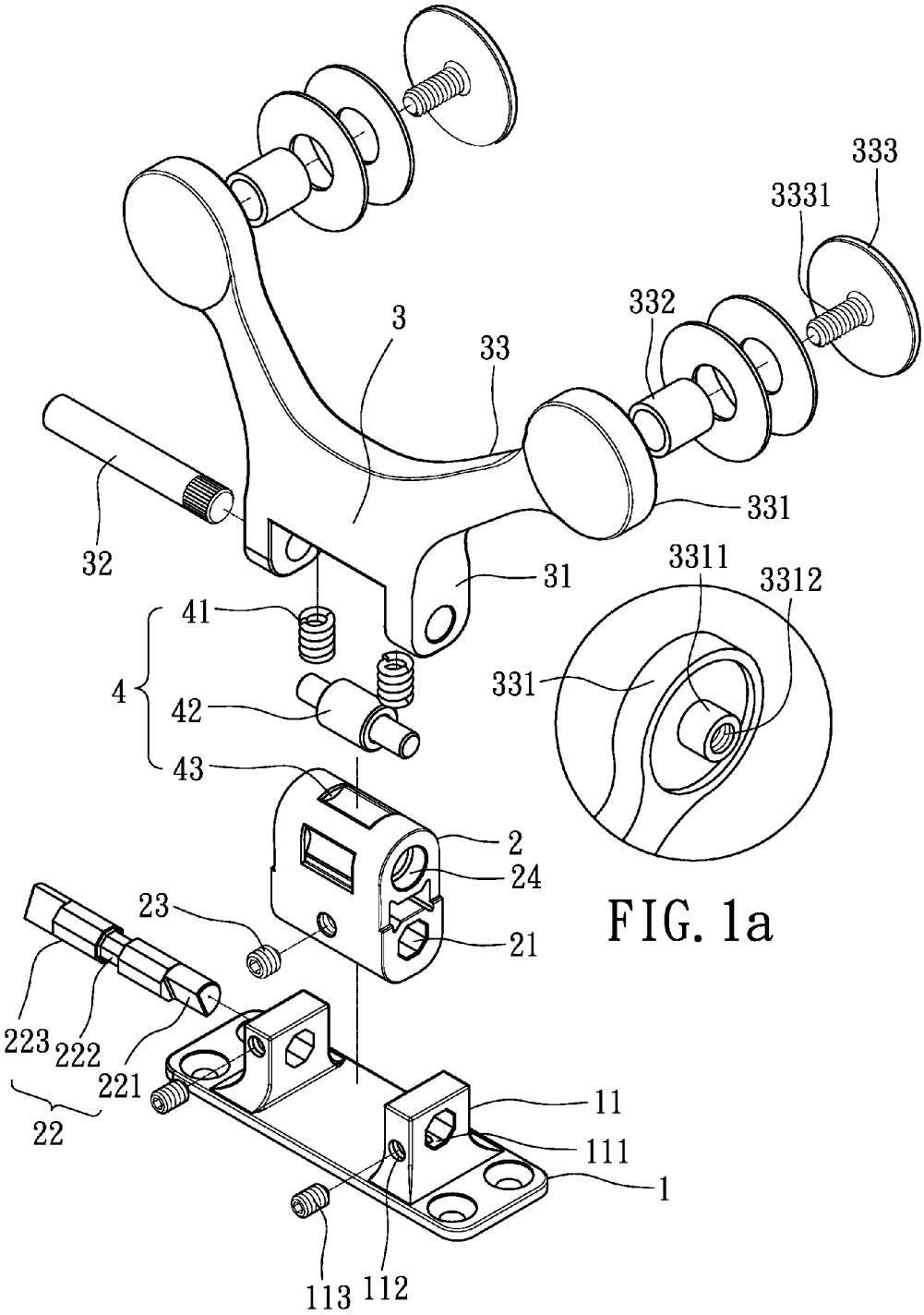
FIG. 1 is an exploded perspective view of a spider hinge for a frameless glass door in accordance with the present invention.
FIG. 1*a* is a schematic perspective view of a round frustum of the spider hinge in accordance with the present invention, showing the opposite side.

Referring to the drawings and initially to FIGS. 1-6, a spider hinge for a frameless glass door in accordance with the present invention comprises a base plate 1, a pivot block 2 connected to the base plate 1, a swing base 3 pivotally connected to the pivot block 2, and a positioning mechanism 4 connected to the swing base 3.

The base plate 1 is adapted to be securely mounted on a door frame or a wall. The base plate 1 has two protrusions 11 perpendicularly extending from one side thereof. Each protrusion 11 has a through hole 111 define therein. Each through hole 111 coaxially corresponds to each other for providing the effort of assembling the base plate 1 and the pivot block 2. Each protrusion 11 has a threaded hole 112 laterally defined therein and extending to communicate with the through hole 111. The two threaded holes 112 are disposed in the same side and in different distance relative to the base plate 1.

The pivot block 2 is in a shape of rectangle. The pivot block 2 has a first end and a second end opposite to the first end. The pivot block 2 has a first hole 21 defined in the first end thereof and extending therethrough. In this embodiment, the first hole 21 is in a shape of polygon. A spindle 22 sequentially passes the through hole 111 in one of the protrusions 11, the first hole 21 in the pivot block 2, and the through hole 111 in the other one protrusion 11. The spindle 22 has two opposite ends each sequentially inward formed with a round portion 221 and a polygonal portion 223 to defined a neck portion 222 in a middle of the spindle 22. Each round portion 221 forms a flat surface (not numbered) on the lateral thereof. The two polygonal portions 223 are complementally received in the first hole 21 to engage with the pivot block 2. A screw 23 is screwed into the pivot block 2 and against the neck portion 222 to prevent the spindle 22 from moving axially. Each flat surface faces a corresponding one of the two threaded holes 112. A screw 113 is screwed into a corresponding one of the two threaded holes 112 and against the corresponding flat surfaces which is off center. The pivot block 2 has a second hole 24 defined in the second end thereof, extending therethrough and parallel to the first hole 21.

When keeping screwing the screws 113, the spindle 22 is pushed and rotated such that the pivot block 2 is driven and rotated for fine adjusting of the angle between the base plate 1 and the pivot block 2. Furthermore, a rotational direction of the spindle 22 is adjustable due to the distances of the threaded holes 112 are different.

Figure 2:
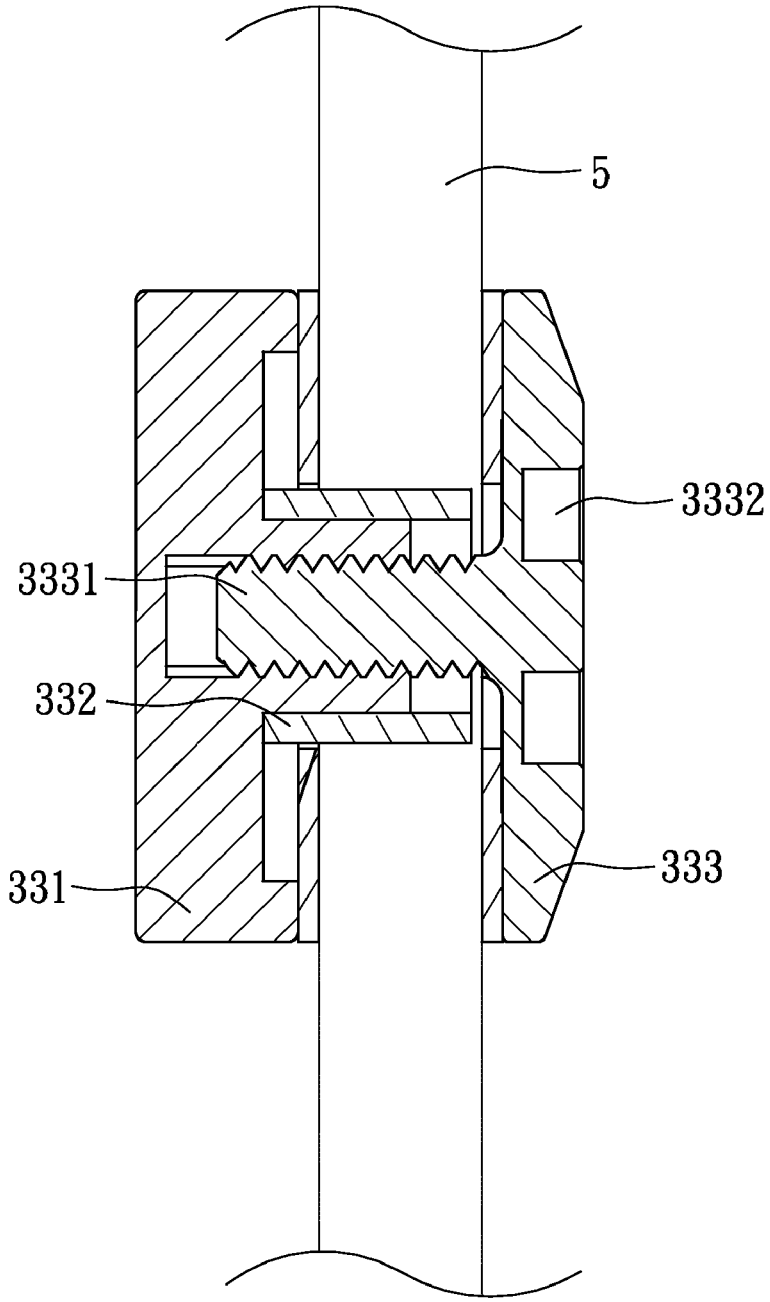
FIG. 2 is a partial cross-sectional view of the spider hinge in accordance with the present invention when assembling with a glass door.
Figure 3:
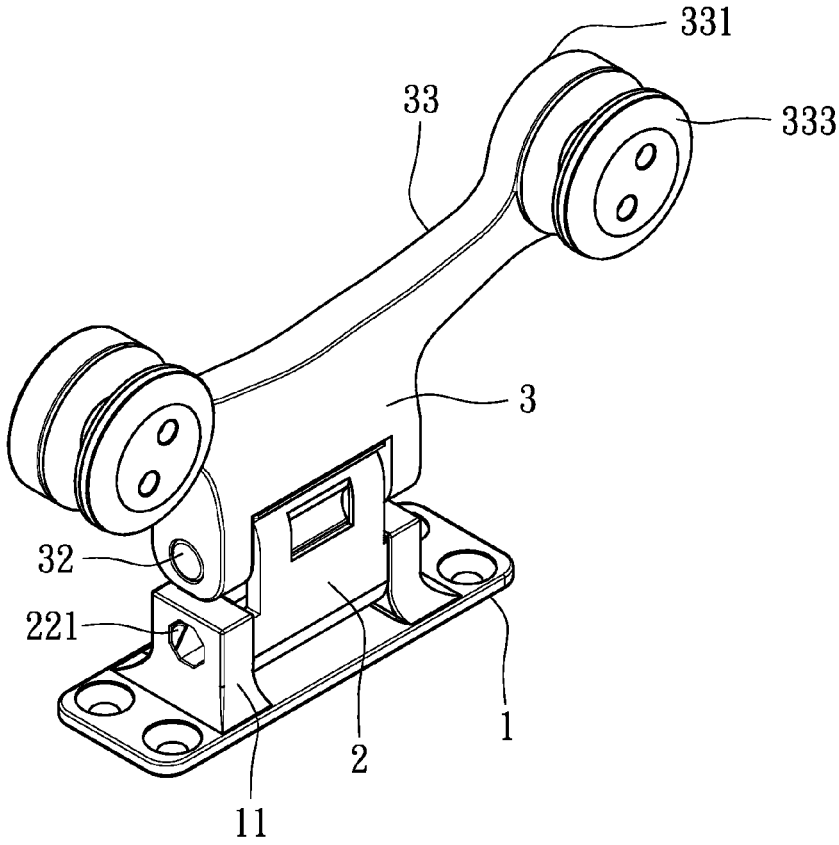
FIG. 3 is an assembled perspective view of the spider hinge in accordance with the present invention.
Figure 4:
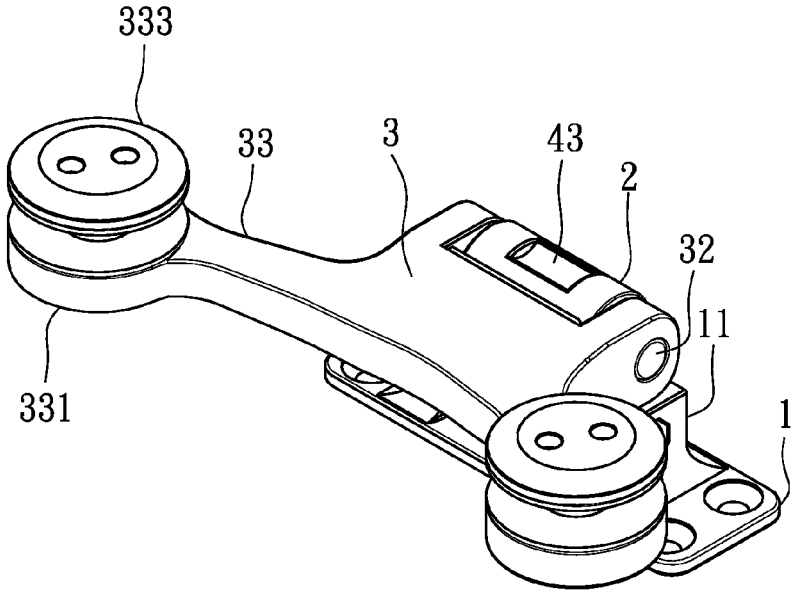
FIG. 4 is an operational perspective view of the spider hinge in FIG. 3.
Figure 5:
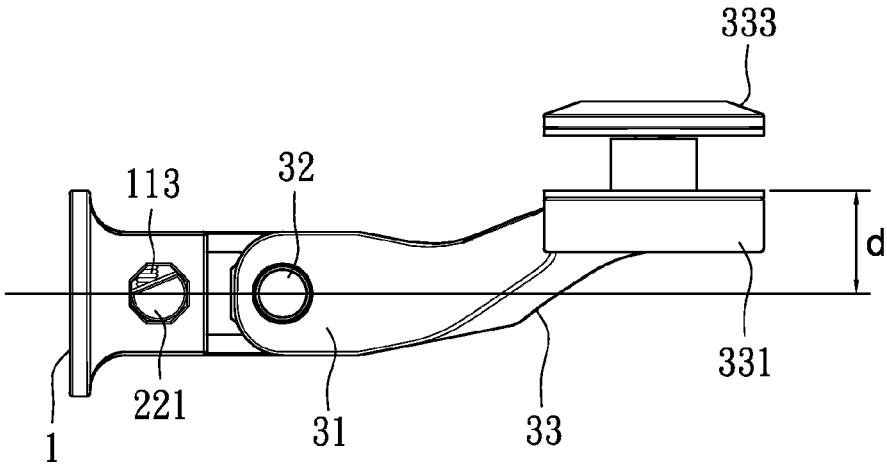
FIGS. 5 and 6 are operational side plan view of the spider hinge in accordance with the present invention.
Figure 6:
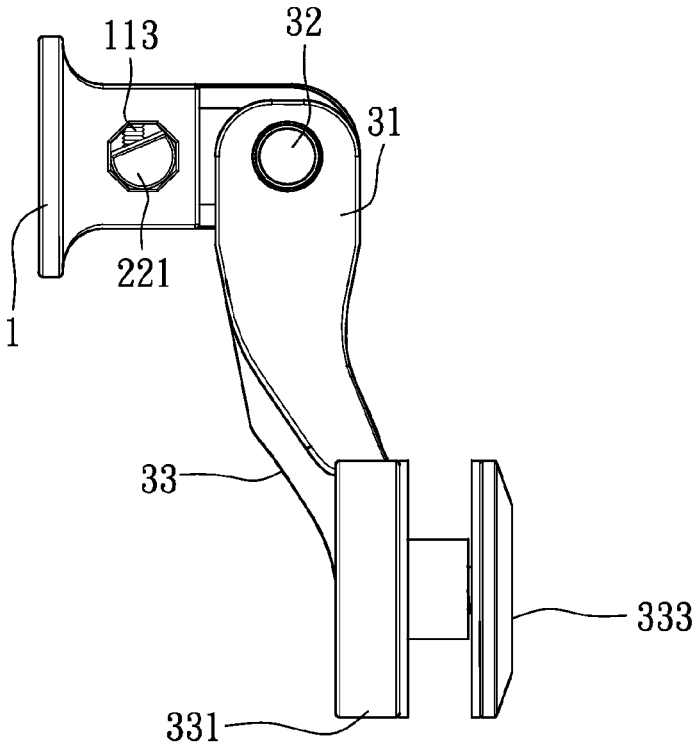
Figure 9:
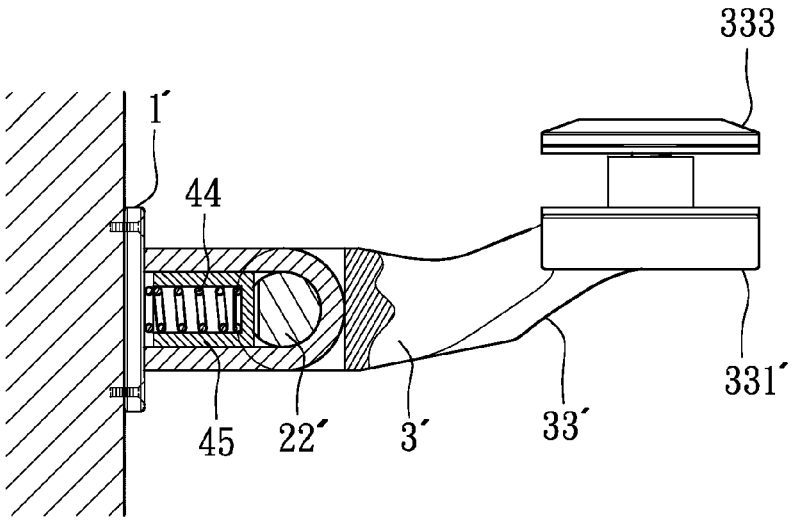
FIGS. 9 and 10 are operational partial cross-sectional view of the second embodiment of the spider hinge in accordance with the present invention.
Figure 10:
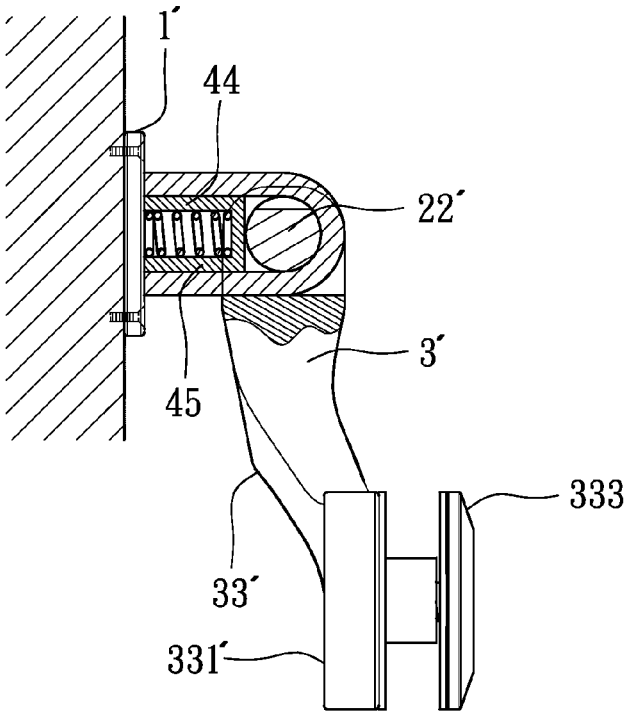

The swing base 3 has a pair of ears 31 outwardly extending therefrom. A pin 32 sequentially passes through one of the ears 31 and the second hole 24 in the pivot block 2 and is engaged with the other one of the ears 31 so that the swing base 3 is rotatable relative to the pivot block 2. The swing base 3 has at least one leg 33 slantwise extending therefrom and opposite to the ears 31. In the preferred embodiment, the swing base 3 has two legs 33. In the following, the preferred embodiment is described. The two legs 33 are symmetrical relative to a middle plane of the swing base 3 like spider legs. Each leg 33 has a round frustum 331 formed on a flat side of a free end thereof and a height difference H is formed between the swing base 3 and the round frustum 331 such that there is no interference between the spider hinge and the glass door. Each round frustum 331 has a stub 3311 extending therefrom and having a threaded hole 3312 defined therein. When assembling with a glass door, a sleeve 332 is inserted into an opening of the glass door. The stub 3311 is inserted into on one end of the sleeve 332. A fastener 333 having a threaded stub 3331 extending therefrom is inserted into the other end of the sleeve 332. The thread stub 3331 is screwed into the threaded hole 3312. The fastener 333 has at least one tooling hole 3332 defined therein as shown in FIG. 2. The at least one tooling hole 3332 is provided to be inserted by a tool for easily rotating the fastener 333. By rotating the fastener 333, the fastener 333 is securely fastened with the stub 3311. Therefore the glass door is firmly connected to the swing base 3.

The positioning mechanism 4 is disposed between the pivot block 2 and the swing base 3. The positioning mechanism 4 includes at least one spring 41, a positioning block 42 abutting against the at least one spring 41, and multiple cavities 43 defined in an outer peripheral of the pivot block 2 for selectively and partially receiving the positioning block 42. In the preferred embodiment, the positioning mechanism 4 has two springs 41 and three cavities 43 radially disposed relative to the second hole 24. The two springs 41 and the positioning block 42 are received in the swing base 3. One end of each of the two springs 41 is connected to the swing base 3 and the other end abuts against the positioning block 42 to bias the positioning block 42 toward a direction way from the swing base 3. The positioning block 42 is in a shape of cylinder. The multiple cavities 43 are in a curved shape. When rotating the swing base 3 in a predefined angle, the positioning block 42 is selectively and partially received in a corresponding one of the multiple cavities 43 to position the swing base 3.

Referring to FIGS. 7-10, a second embodiment of a spider hinge for a frameless glass door in accordance with the present invention is illustrated. The spider hinge comprises a base plate 1', a pivot block 2' connected to the base plate 1', and a swing base 3' connected to the pivot block 2'.

The base plate 1' is adapted to be mounted to a door frame or a wall. The pivot block 2' is fastened with base plate 1'. The pivot block 2' has a second hole 24' defined therein and extending therethrough. The swing base 3' has a pair of ears 31 ' extending therefrom and corresponding to the second hole 24' and two legs 33' respectively slantwise extending from the swing base 3'. Each leg 33' has a round frustum 331' having a stub 3311' and a threaded hole 3312' defined in the stub 3311'. A spindle 22' sequentially passes through one of the ears 31', the second hole 24', and the other one of the ears 31'. The spindle 22' has two opposite ends each formed with a round portion 221' and a cavity 224' defined in a middle thereof. Each round portions 221' forms a flat surface (not numbered) on the lateral thereof. Each ear 31' has a threaded hole 311' defined in a lateral thereof. Two screws 113 respectively screw into a corresponding one of the two threaded holes 311' and abut against the flat surface which is off center for fine adjusting of the angle between the pivot block 2' and the swing base 3'.

The spider hinge of the embodiment further comprises a positioning mechanism 4'. The positioning mechanism 4' includes at least one spring 44 and a positioning block 45. The pivot block 2' has a hole 46 defined therein and communicated with the second hole 24' for slidably receiving the positioning block 45. The positioning block 45 has at least one opening 451 defined therein for receiving the at least one spring 44. One end of the at least one spring 44 abuts against the base plate 1' and the other end of the at least one spring 44 abuts a bottom of the at least one opening 451 to bias the positioning block 45 toward the spindle 22'. When rotating the swing base 3' in a predefined angle, the positioning block 45 corresponds to the cavity 224 and is partially received in the cavity 224 to selectively position the swing base 3'.

Figure 11:
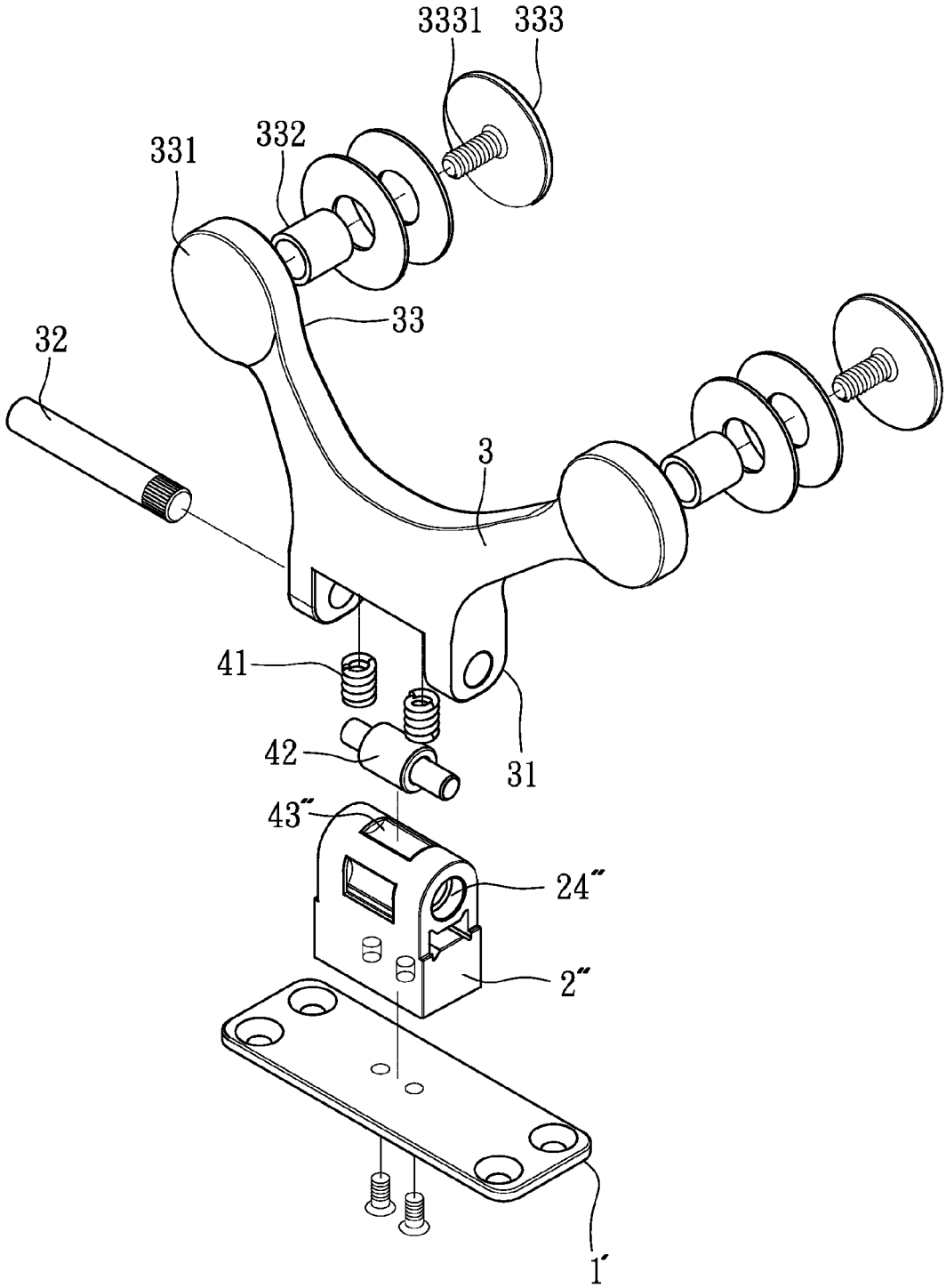
FIG. 11 is an exploded perspective view of a third embodiment of the spider hinge in accordance with the present invention.
Figure 12:
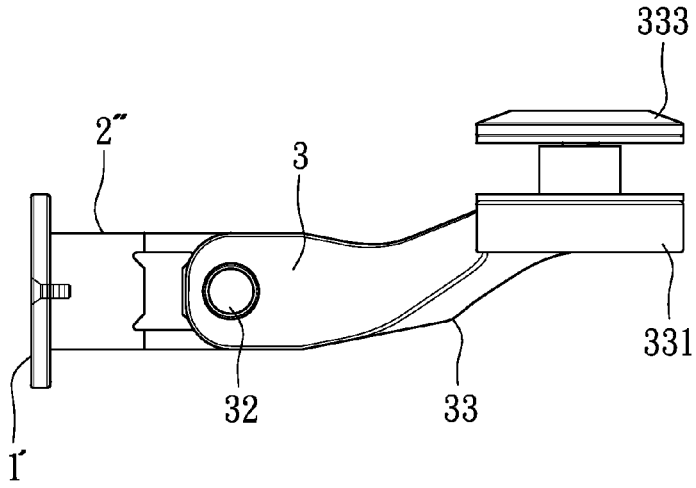
FIGS. 12 and 13 are operational side view of the third embodiment of the spider hinge in accordance with the present invention.
Figure 13:
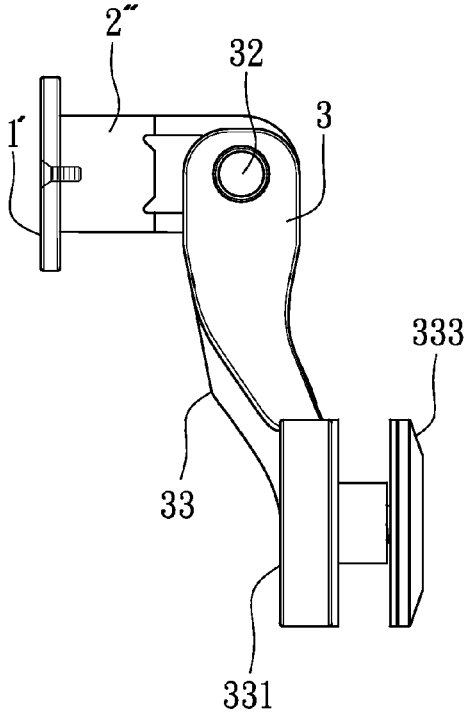
Figure 14:
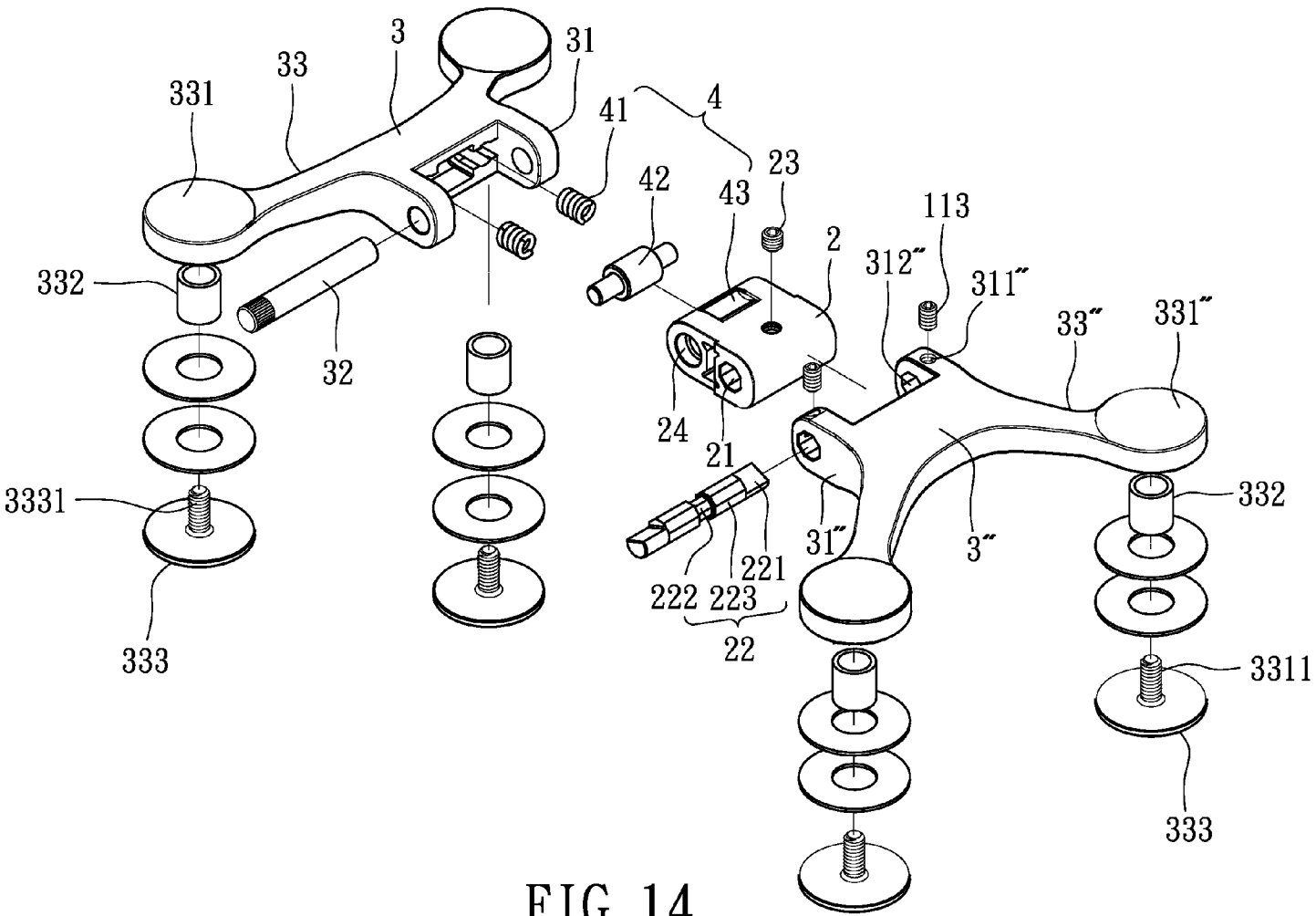
FIG. 14 is an exploded perspective view of a fourth embodiment of the spider hinge in accordance with the present invention.
Figure 15:
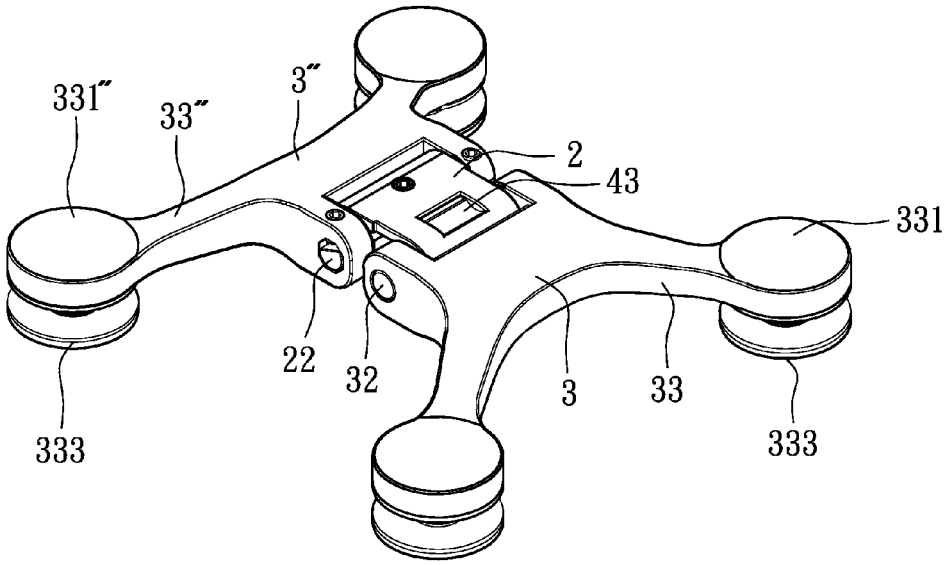
FIG. 15 is an assembled perspective view of the fourth embodiment of the spider hinge in accordance with the present invention.
Figure 16:
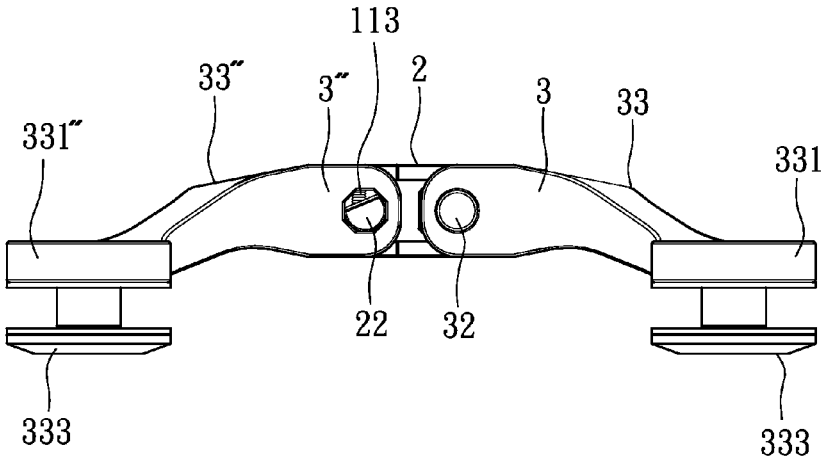
FIG. 16 is a side plan view of the fourth embodiment of the spider hinge in FIG. 15.
Figure 17:
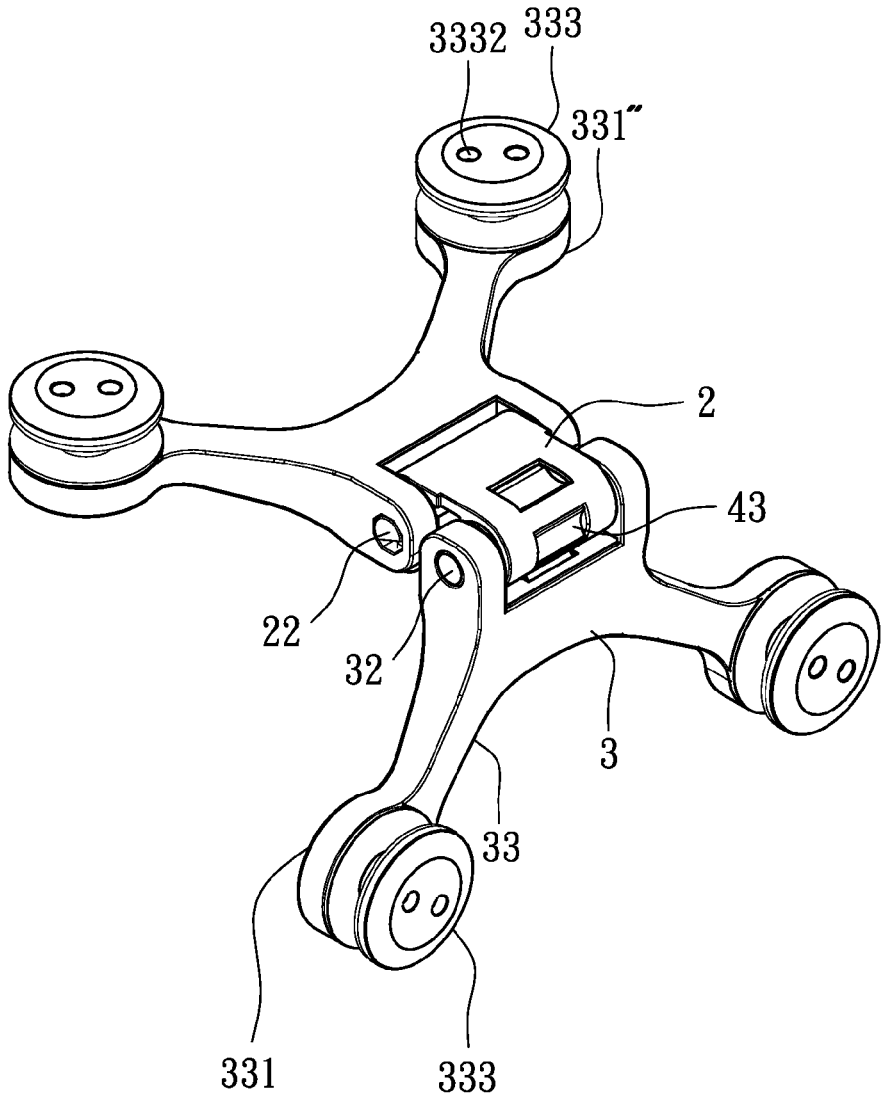
FIG. 17 is an operational perspective view of the fourth embodiment of the spider hinge in FIG. 15.

Referring to FIGS. 11-13, a third embodiment of a spider hinge for a frameless glass door in accordance with the present invention is illustrated. The spider hinge comprises a base plate 1', a pivot block 2" connected to the base plate 1', and a swing base 3 pivotally connected to the pivot block 2".

The elements and the efforts which are the same with the foregoing embodiment are not described, only the differences are described, hereinafter. The pivot block 2" is fastened to the base plate 1'. The pivot block 2" has a second hole 24" defined therein and extending therethrough for pivotally connecting the swing base 3. Multiple cavities 43" are defined in an outer peripheral of the pivot block 2" for selectively and partially receiving a positioning block 42.

Referring to FIGS. 14-19, a fourth embodiment of a spider hinge for a frameless glass door in accordance with the present invention is illustrated. The spider hinge of this embodiment comprises a first swing base 3", a pivot block 2 connected to the first swing base 3", a second swing base 3 pivotally connected to the pivot block 2, and a positioning mechanism 4 connected to the second swing base 3.

The elements and the efforts which are the same with the first embodiment are not described, only the differences are described. The first swing base 3" has a pair of ears 31" extending therefrom and two legs 33" slantwise extending therefrom opposite to the ears 31". Each leg 33' has a round frustum 331" to assembly with a fastener 333 and secure with a glass door 5. Each ear 31" has a through hole 312" defined therein and a threaded hole 311" laterally defined therein and communicated with the through hole 312". The functions and efforts of the ears 31" are same as that of the protrusions 11 of the first embodiment. Therefore the swing base 3" and the pivot block 2 are connected each other by inserting a spindle 22.

Figure 18:
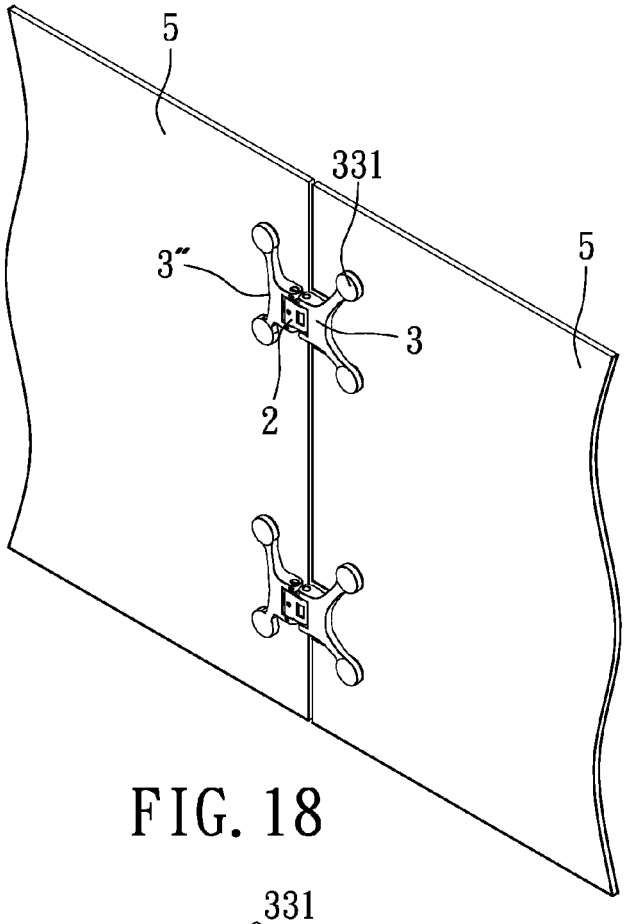
FIG. 18 is a schematic perspective view of the fourth embodiment of the spider hinge in accordance with the present invention when assembling with the frameless glass door.
Figure 19:
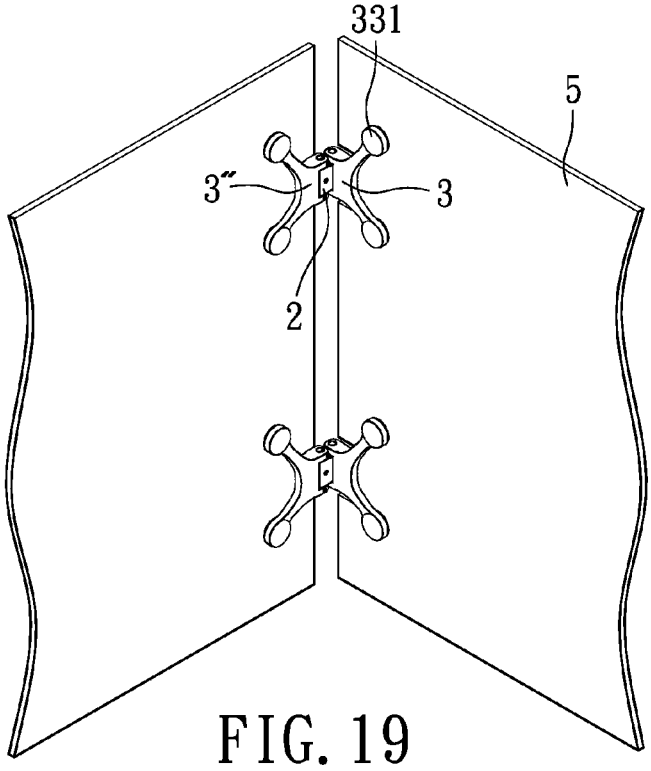
FIG. 19 is an operational schematic perspective view of the fourth embodiment of the spider hinge in FIG. 18.
Figure 20:
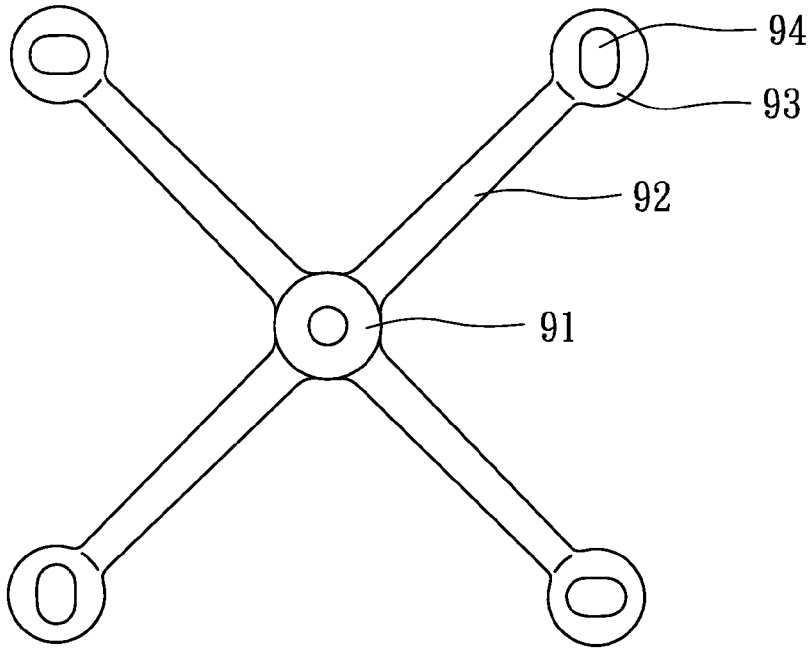
FIG. 20 PRIOR ART
FIG. 20 is a front plan view of a conventional spider fitting in accordance with the prior art.
Figure 21:
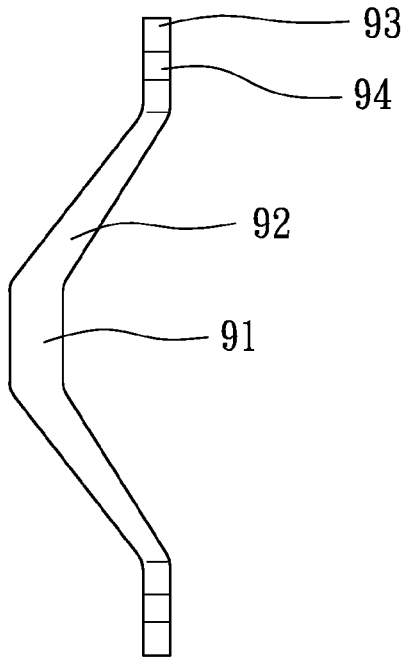
FIG. 21 PRIOR ART
FIG. 21 is a side plan view of the spider fitting in FIG. 20.

Referring to FIGS. 18 and 19, both the first swing base 3" and the second swing bases 3 are provided to secure the glass door 5. The first swing base 3" is used to fine adjust the angle between the first swing base 3" and the pivot block 2. The second swing base 3 is used to rotate about the pivot block 2.

Although the invention has been explained in relation to its preferred embodiment, it is to be understood that many other possible modifications and variations can be made without departing from the spirit and scope of the invention as hereinafter claimed.

What is claimed is:

1. A spider hinge for a frameless glass door comprising:

a base plate having a first side and a second side opposite to the first side, the first side being adapted to be mounted on a door frame;

a pivot block connected to the base plate, the pivot block having a first end and a second end opposite to the first end, the first end of the pivot block connected to the second side of the base plate;

a swing base pivotally connected to the pivot block, the swing base having a pair of ears extending outwardly therefrom for pivotally connected to the second end of the pivot block, the swing base having at least one leg slantwise extending therefrom and opposite to the ears for keeping no interference between the spider hinge and the glass door, the at least one leg having a round frustum formed on a free end thereof, the round frustum formed with a closed side and having a threaded hole defined therein toward the closed side for assembling with a fastener such that the glass door is secured by fastening the fastener and the round frustum; and a positioning mechanism disposed between the pivot block and the swing base, the positioning mechanism comprising at least one spring and a positioning block abutting against the at least one spring and biased by the at least one spring to position the swing base.

2. The spider hinge for a frameless glass door as claimed in claim 1, wherein the pivot block has a first hole defined in the first end thereof and a second hole defined in the second end thereof.

3. The spider hinge for a frameless glass door as claimed in claim 2, wherein the base plate has two protrusions perpendicularly extending from the second side thereof, each protrusion having a through hole define therein and coaxially corresponding to each other for providing the effort of assembling the base plate and the pivot block.

4. The spider hinge for a frameless glass door as claimed in claim 3 further comprising a spindle passed through the through holes in the two protrusions and the first hole in the pivot block, the spindle having two opposite ends each formed with a round portion, each round portion having a flat surface laterally formed thereon and pushed by a screw to adjust a angle between the pivot block and the base plate.

5. The spider hinge for a frameless glass door as claimed in claim 3 further comprising a pin passed through the ears and the second hole in the pivot block for pivotally connecting the swing base and the pivot block.

6. The spider hinge for a frameless glass door as claimed in claim 1, wherein the pivot block has a second hole defined in the second end thereof.

7. The spider hinge for a frameless glass door as claimed in claim 6 further comprising a pin passed through the ears of the swing base and the second hole in the pivot block for pivotally connecting the swing base and the pivot block.

8. The spider hinge for a frameless glass door as claimed in claim 6 further comprising a spindle passed through the ears of the swing base and the second hole in the pivot block, the spindle having two opposite ends each formed with a round portion, each round portion having a flat surface laterally formed thereon and pushed by a screw to adjust a angle between the pivot block and the swing base.

9. The spider hinge for a frameless glass door as claimed in claim 2, wherein the pivot block has multiple cavities defined therein for selectively and partially receiving the positioning block.

10. The spider hinge for a frameless glass door as claimed in claim 7, wherein the pivot block has multiple cavities defined therein for selectively and partially receiving the positioning block.

11. The spider hinge for a frameless glass door as claimed in claim 8, wherein the pivot block has a hole defined therein for slidably receiving the positioning block, the pivot block having a cavity defined in a middle thereof for selectively and partially receiving the positioning block.

12. The spider hinge for a frameless glass door as claimed in claim 1, wherein the fastener has at least one tooling hole defined therein for easily screwing the fastener and a threaded stub extending therefrom for fastening with the round frustum of the swing base.

* * * * *

UNITED STATES PATENT AND TRADEMARK OFFICE

CERTIFICATE OF CORRECTION

PATENT NO. : 8,046,873 B2
APPLICATION NO. : 12/234710
DATED : November 1, 2011
INVENTOR(S) : James Chang It is certified that error appears in the above-identified patent and that said Letters Patent is hereby corrected as shown below:

On the Title page of the patent, add (73) Assignee: DOOR & WINDOW HARDWARE CO., Taichung City (TW).

Signed and Sealed this
Twelfth Day of February, 2013

Teresa Stanek Rea
*Acting Director of the United States Patent and Trademark Office*